US009166339B2

(12) United States Patent
Sakakura

(10) Patent No.: US 9,166,339 B2
(45) Date of Patent: Oct. 20, 2015

(54) CONNECTOR HOUSING HAVING DRAINAGE PATHWAYS

(75) Inventor: Emi Sakakura, Yokkaichi (JP)

(73) Assignee: Sumitomo Wiring Systems, Ltd. (JP)

( * ) Notice: Subject to any disclaimer, the term of this patent is extended or adjusted under 35 U.S.C. 154(b) by 20 days.

(21) Appl. No.: 14/342,884

(22) PCT Filed: Apr. 9, 2012

(86) PCT No.: PCT/JP2012/059676

§ 371 (c)(1),
(2), (4) Date: Apr. 28, 2014

(87) PCT Pub. No.: WO2013/035369

PCT Pub. Date: Mar. 14, 2013

(65) Prior Publication Data

US 2014/0242832 A1 Aug. 28, 2014

(30) Foreign Application Priority Data

Sep. 10, 2011 (JP) ..... 2011-197736

(51) Int. Cl.

| | |
|---|---|
| ***H01R 4/60*** | (2006.01) |
| ***H01R 13/64*** | (2006.01) |
| ***H01R 13/52*** | (2006.01) |
| *H01R 43/18* | (2006.01) |

(52) U.S. Cl.
CPC ..... *H01R 13/64* (2013.01); *H01R 13/5227* (2013.01); *H01R 43/18* (2013.01)

(58) Field of Classification Search
CPC ..... H01R 13/52; H01R 13/5227
USPC ..... 439/190, 205, 206, 207
See application file for complete search history.

(56) References Cited

U.S. PATENT DOCUMENTS

| | | | | |
|---|---|---|---|---|
| 5,769,648 | A * | 6/1998 | Hayashi | 439/206 |
| 5,860,822 | A * | 1/1999 | Nishide et al. | 439/206 |
| 5,959,249 | A * | 9/1999 | Hotta | 174/60 |
| 5,967,830 | A | 10/1999 | Tsuji | |

(Continued)

FOREIGN PATENT DOCUMENTS

| | | |
|---|---|---|
| EP | 2251940 | 11/2010 |
| JP | 10-27646 | 1/1998 |
| JP | 2005-158599 | 6/2005 |

OTHER PUBLICATIONS

International Search Report of Apr. 23, 2012.

(Continued)

*Primary Examiner* — Vanessa Girardi
(74) *Attorney, Agent, or Firm* — Gerald E. Hespos; Michael J. Porco; Matthew T. Hespos

(57) ABSTRACT

The invention achieves prevention of sink mark and drainage within a hood part. A housing (10) made of synthetic resin has a hood part (17) extending forward from a terminal holding part (11), and a guide wall part (19) having a guide recessed part (15) formed in a back end part of an inner surface. The housing (10) is formed with a longitudinal mold drawing pathway (20) which includes a mold drawing recessed part (21) having a form which recesses a region in front of a region corresponding to the guide recessed part (15) of the outer surface of the guide wall part (19), and a mold drawing port (22) having a form that communicates with the mold drawing recessed part (21) and passes through a back surface wall (18).

2 Claims, 5 Drawing Sheets

(56) References Cited

U.S. PATENT DOCUMENTS

| | | | | |
|---|---|---|---|---|
| 6,375,500 | B1 * | 4/2002 | Murakami et al. | 439/587 |
| 7,532,458 | B2 * | 5/2009 | Sasaki et al. | 361/622 |
| 7,575,463 | B2 * | 8/2009 | Mase et al. | 439/352 |
| 8,079,857 | B2 * | 12/2011 | Zhu | 439/205 |
| 8,257,101 | B2 * | 9/2012 | Ichio | 439/206 |
| 2002/0009932 | A1 | 1/2002 | Inaba et al. | |

OTHER PUBLICATIONS

International Preliminary Examination Report of Jun. 18, 2012.

* cited by examiner

CONNECTOR HOUSING HAVING DRAINAGE PATHWAYS

BACKGROUND

1. Field of the Invention

The present invention relates to a connector.

2. Description of the Related Art

JP H07-220798 A discloses a connector provided with a molded housing made of a synthetic resin, and a male terminal fitting having an elongated tab formed at a front end. Hereinafter, characteristics of the connector will be described with reference to FIG. 5.

A housing 100 is constituted by integrally forming a terminal holding part 101 formed with a terminal accommodating chamber 102 penetrating in a front and back direction, and a hood part 103 extending forward from a front end of the terminal holding part 101. An opening part of a back end part of the terminal accommodating chamber 102 is a terminal insertion port 107 for inserting the terminal fitting 106, and a front end-side region of the terminal accommodating chamber 102 is a posture stabilization part 108 for holding the inserted terminal fitting 106 so as not to tilt.

SUMMARY OF THE INVENTION

In the connector, as a means for smoothly performing insertion of the terminal fitting 106 into the terminal accommodating chamber 102, a guide recessed part 109 having a form of recessed from the inner surface of the posture stabilization part 108 is formed on an inner surface of the terminal insertion port 107. However, the guide recessed part 109 has a form that cuts out an outer surface of the terminal holding part 101 and an inner surface of an outer wall part 104 forming the terminal accommodating chamber 102. For that reason, in a region corresponding to the posture stabilization part 108 in front of the terminal insertion port 107 of the outer wall part 104, a wall thickness is too thick, and there is a fear of an occurrence of sink mark.

Meanwhile, when the connector is used in a posture in which the hood part 103 is set to face upward, moisture and dew condensation water flowing into the hood part 103 are accumulated, and as a result, there is also a fear of an occurrence of leakage between the terminal fittings 106.

The invention was completed based on the above-described circumstances, and an object of thereof is to achieve prevention of sink mark and a drainage in the hood part.

As a means for achieving the above-described object, a connector of the invention includes:

a housing made of a synthetic resin;

a terminal fitting;

a terminal holding part which constitutes the housing and is formed with a terminal accommodating chamber penetrating in a front and back direction;

a hood part which constitutes the housing, is molded integrally with the terminal holding part, and extends forward from a front end of the terminal holding part;

an outer wall part which constitutes an outer surface of the terminal holding part and faces the terminal accommodating chamber;

a back surface wall which constitutes the hood part and has a form of projecting outward from the outer wall part;

a terminal insertion port which constitutes an opening part of a back end part of the terminal accommodating chamber and into which the terminal fitting is inserted;

a posture stabilization part which constitutes a front end side region of the terminal accommodating chamber and holds the inserted terminal fittings so as not to tilt;

a guide recessed part which is formed in a region corresponding to the terminal insertion port of the inner surface of the outer wall part and has a form recessed from the inner surface of the posture stabilization part; and a guide wall part that constitutes a region in which the guide recessed part is formed in a circumferential direction of the outer wall;

wherein a plurality of mold drawing recessed parts is recessed in a region in front of the region corresponding to the guide recessed part of the outer surface of the guide wall part, and one mold drawing port or a plurality of mold drawing ports is formed to penetrate through the back surface wall, and the mold drawing ports communicate with each of the mold drawing recessed parts to form a mold drawing pathway extending in the front and back direction together with the mold drawing recessed parts, and a plurality of drainage pathways is recessed in a groove shape and a long the front and back direction on an inner peripheral surface of a peripheral wall part constituting the hood part and each of the drainage pathways is formed so as to be connected to the mold drawing pathway in a straight line.

According to such a connector, since the region in front of the region corresponding to the guide recessed part of the outer surface of the guide wall part, i.e., the region corresponding to the posture stabilization part is thin by forming the mold drawing pathway, an occurrence of sink mark is prevented. Furthermore, moisture in the hood part is discharged to the back exterior of the hood part by passing through the mold drawing pathway. Furthermore, since the mold drawing pathway has a form of extending in the front and back direction and penetrating through the back surface wall of the hood part on the outer surface of the guide wall part, the mold drawing pathway can be formed by a mold that is drawn forward. Therefore, there is no need to use a slide mold that is drawn in a direction intersecting with the front and back direction.

Furthermore, since each of the drainage pathways and the mold drawing pathways is continuous in a straight line, water entered the foot part is smoothly discharged to the rear of the root part through the drainage pathways and the mold drawing pathways.

DETAILED DESCRIPTION OF THE PREFERRED EMBODIMENT

According to the connector of the invention, each of the mold drawing pathways and the drainage pathways may be formed in the same width.

<Embodiment 1>

Figure 2:
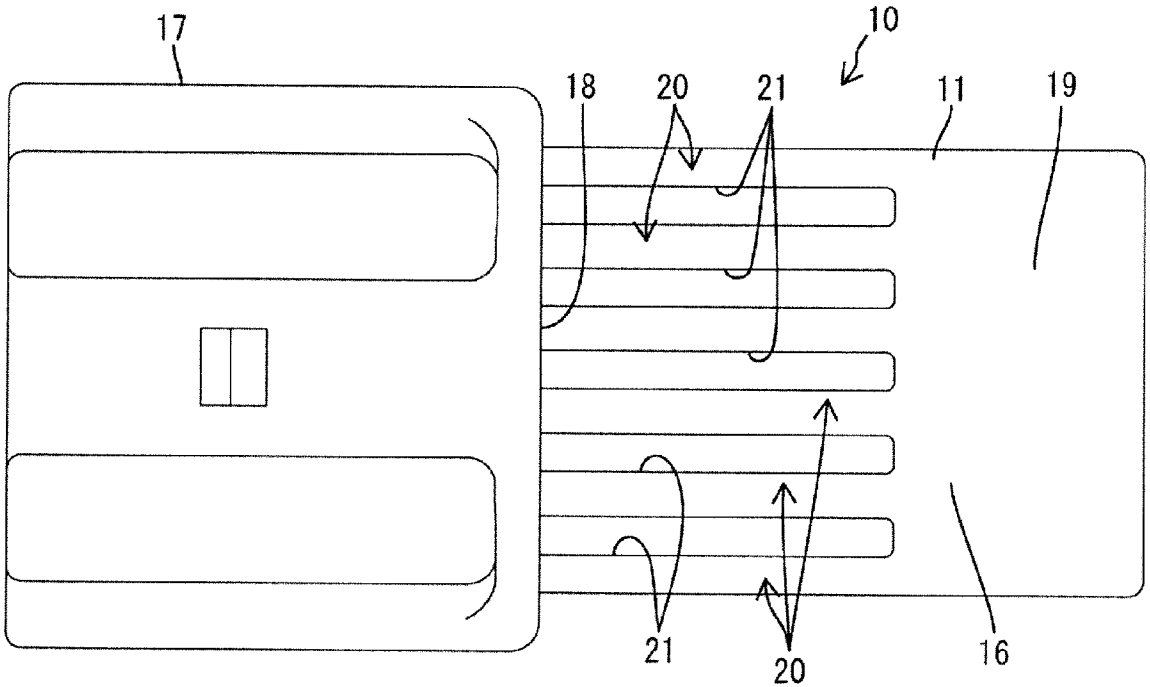
FIG. 2 is a plan view of the housing.
Figure 3:
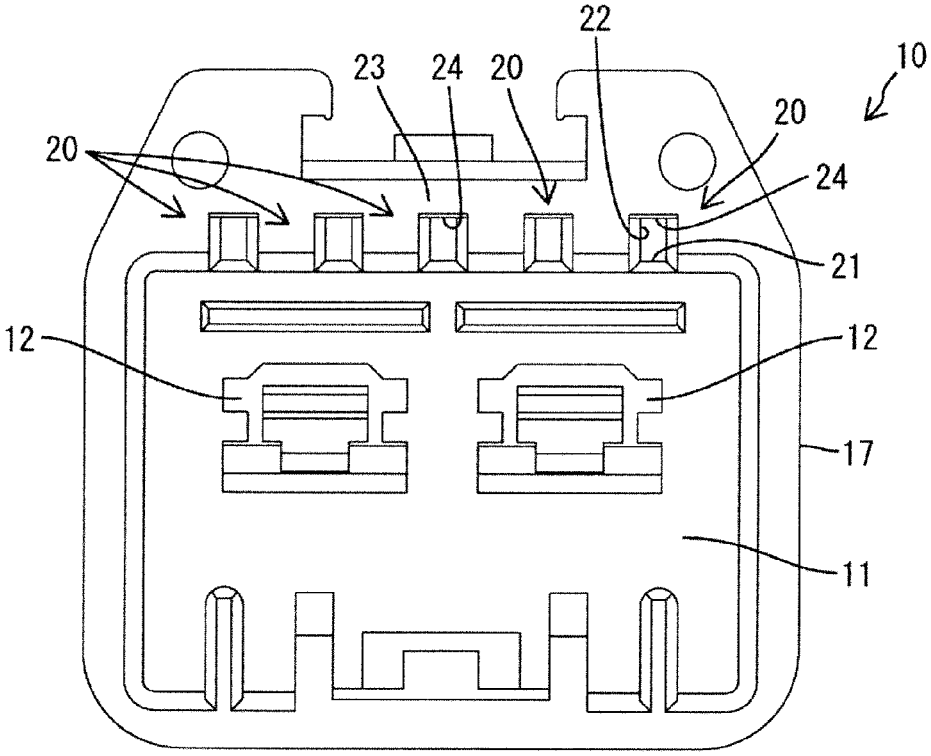
FIG. 3 is a front view of the housing.
Figure 4:
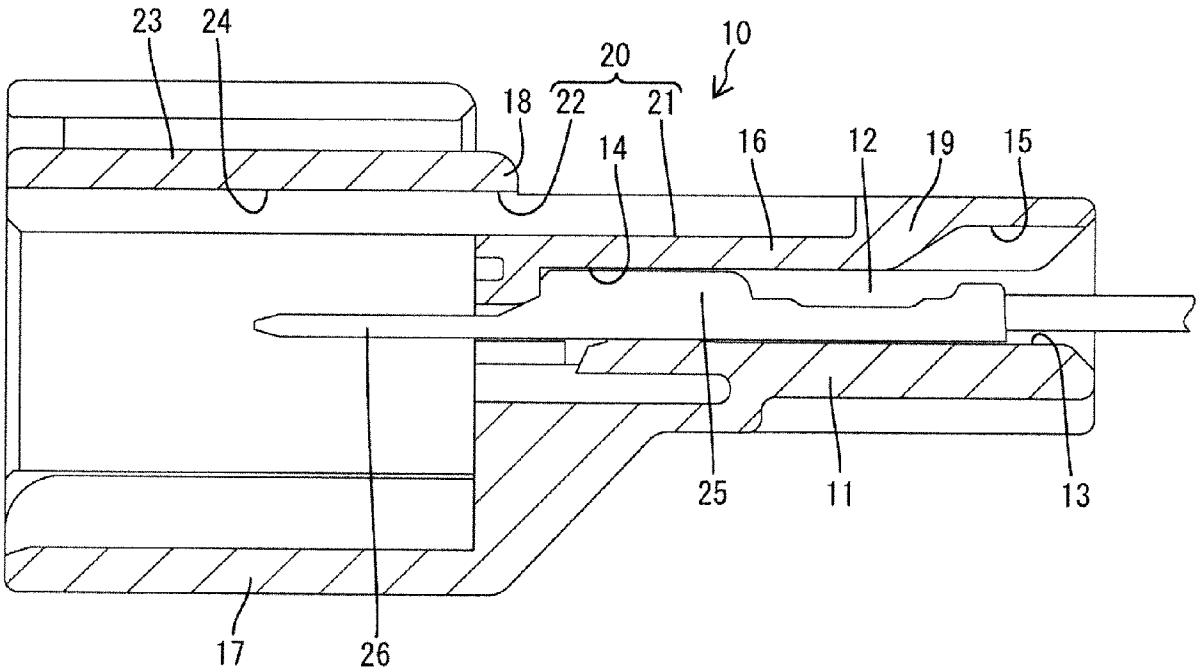
FIG. 4 is a cross-sectional view of a state in which a terminal fitting is attached to the housing.
Figure 5:
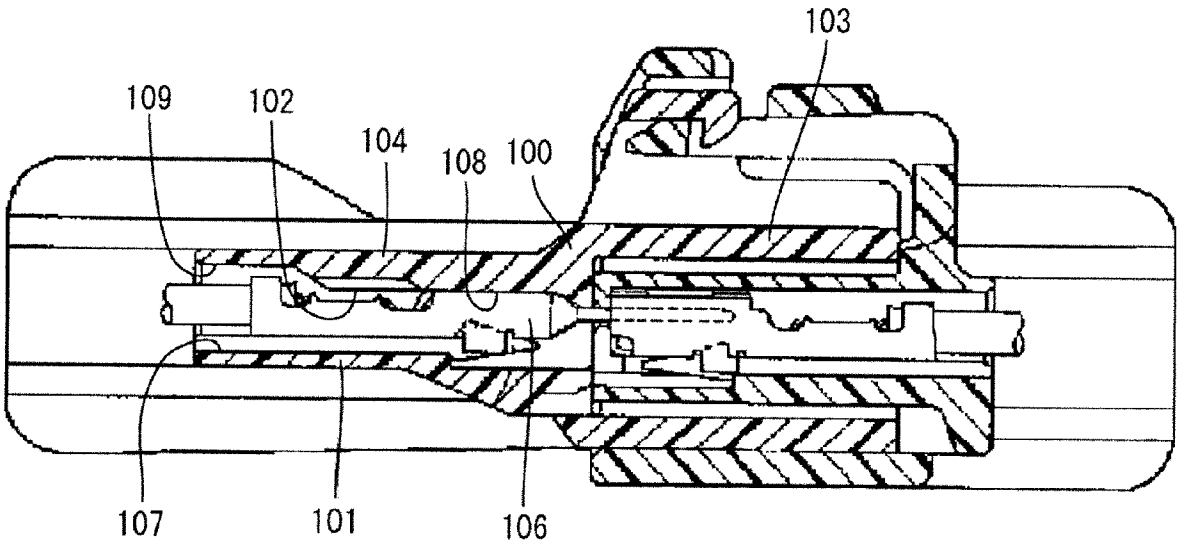
Fig. 5 PRIOR ART
FIG. 5 is a cross-sectional view of the related art.

Hereinafter, embodiment 1 embodying the invention will be described with reference to FIGS. 1 to 4. As illustrated in FIG. 4, the connector of the embodiment 1 is configured to include a housing 10, and a male terminal fitting 25 having an elongated tab 26 formed at a front end thereof.

The housing 10 is made of a molded synthetic resin, and is constituted by integrally forming a terminal holding part 11 formed with a pair of left and right terminal accommodating chambers 12 penetrating in the front and back direction is formed, and a hood part 17 extending forward from the front end of the terminal holding part 11. An opening part of a back end part of the terminal accommodating chamber 12 is a terminal insertion port 13 for inserting the terminal fitting 25. A front end side region (a region in front of the terminal insertion port 13) of the terminal accommodating chamber 12 is a posture stabilization part 14 for holding the inserted terminal fitting 25 so as not to tilt.

The terminal holding part 11 has an outer wall part 16 that constitutes an outer surface thereof and faces the interior of the terminal accommodating chamber 12. A wall part of the outer wall part 16 constituting a ceiling surface of the terminal accommodating chamber 12 in the circumferential direction is a guide wall part 19. In a region of the inner surface (the ceiling surface of the terminal accommodating chamber 12) of the guide wall part 19 corresponding to the terminal insertion port 13, a guide recessed part 15 having a form of being recessed from the inner surface (the ceiling surface) of the posture stabilization part 14 is formed, as a means for smoothly inserting the terminal fitting 25 into the terminal accommodating chamber 12. That is, the upper surface region of the outer wall part 16 formed with the guide recessed part 15 in the circumferential direction is the guide wall part 19. By forming the guide recessed part 15, a height dimension of the terminal insertion port 13 is greater than a height dimension of the posture stabilization part 14.

The hood part 17 has a back surface wall 18 having a form of projecting outward (upward) from the guide wall part 19 of the terminal holding part 11. In the case where the back surface wall 18 of the hood part 17 projects outward from the guide wall part 19, when the housing 10 is molded only by a mold (not illustrated) opened in the front and back direction, the outer surface of the guide wall part 19 has a flush shape from the front end to the back end, and it is not possible to form a height difference on the upper surface of the guide wall part 19 since the outer surface (upper surface) of the guide wall part 19 is molded by a mold opened backward. Meanwhile, on the inner surface (the lower surface) of the guide wall part 19, by forming the guide recessed part 15 in the terminal insertion port 13, a height difference occurs between the ceiling surface of the terminal insertion port 13 and the ceiling surface of the posture stabilization part 14.

Accordingly, even if a vertical dimension (thickness dimension) of the guide wall part 19 is reduced to a required minimum dimension in the back end part region corresponding to the terminal insertion port 13, in the region corresponding to the posture stabilization part 14, the thickness dimension of the outer wall part 16 becomes greater than necessary. Therefore, there is a risk of incorrect deformation called "sink mark" in a part corresponding to the posture stabilization part 14 of the outer wall part 16 while molding.

Furthermore, in the case of using the connector in a posture where the hood part 17 is opened upwardly, when water flows into the hood part 17 from the outside or dew condensation occurs within the hood part 17, it is feared that the inflow moisture or dew condensation water is accumulated in the hood part 17, and leakage occurs between the terminal fittings 25 by the accumulated water.

Figure 1:
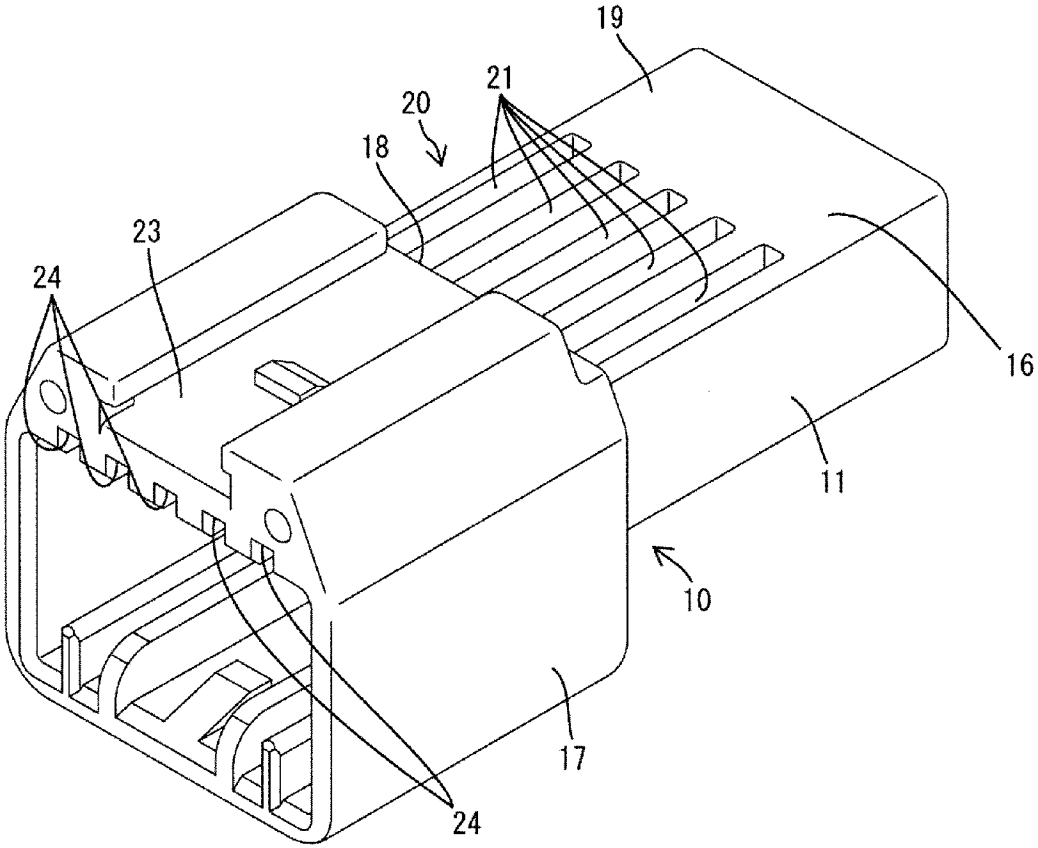
FIG. 1 is a perspective view of a housing of embodiment 1.

In this embodiment, as a countermeasure thereof, a mold drawing pathway 20 is formed in the housing 10. The mold drawing pathway 20 is constituted by five mold drawing recessed parts 21 linearly extending in the front and back direction formed in the terminal holding part 11 as illustrated in FIGS. 1, 2, and 4, and five mold drawing ports 22 penetrating through the back surface wall 18 of the hood part 17 back and forth as illustrated in FIGS. 3 and 4. The five mold drawing recessed parts 21 are arranged in parallel with a fixed pitch in the horizontal direction (width direction).

As illustrated in FIG. 4, a forming region in the front and back direction of the mold drawing recessed part 21 extends from the back end surface of the back surface wall 18 to a position slightly in front of the front end of the guide recessed part 15 (i.e., a position slightly in front of the back end of the posture stabilization part 14). As illustrated in FIG. 3, the five mold drawing ports 22 have the same width dimension as the mold drawing recessed part 21 and are arranged at the same pitch as the five mold drawing recessed parts 21. Thus, the five mold drawing recessed parts 21 and the five mold drawing ports 22 correspond to one another one-to-one, and the corresponding mold drawing recessed part 21 and mold drawing port 22 directly communicate with each other.

In this embodiment, the housing 10 is formed with a longitudinal mold drawing pathway 20 which includes a mold drawing recessed part 21 having a form in which a region in front of the region corresponding to the guide recessed part 15 of the outer surface of the guide wall part 19 (the region corresponding to the posture stabilization part 14) is recessed, and a mold drawing port 22 having a form of directly communicating with the mold drawing recessed part 21 and penetrating through the back surface wall 18. With this configuration, since the region in front of the guide recessed part 15 of the guide wall part 19, i.e., the region corresponding to the posture stabilization part 14 is thin by forming the mold drawing pathway 20, an occurrence of sink mark is prevented.

Furthermore, moisture in the hood part 17 is discharged into the back exterior of the hood part 17 by penetrating through the mold drawing pathway 20. Moreover, since the mold drawing pathway 20 has the form that extends in the front and back direction on the outer surface of the guide wall part 19 and penetrates through the back surface wall 18 of the hood part 17, the mold drawing pathway 20 can be formed by a mold that is drawn forward. Therefore, there is no need to use a slide mold that is drawn in a direction intersecting with the front and back direction.

Furthermore, on the upper surface wall 23 constituting the hood part 17 (a peripheral wall part as a constituent element of the invention), five drainage pathways 24 are formed in the front and back direction. The drainage pathways have a form in which an inner peripheral surface of the upper surface 23 is recessed in a groove shape, and are connected to the mold drawing pathways 20 in a straight line. The five drainage pathways 24 have the same width dimension as the mold drawing pathways 20, and are arranged at the same pitch as the mold drawing pathways 20. Thus, the drainage pathways 24 and the mold drawing pathways 20 correspond to one another one-to-one, and the drainage pathways 24 and the mold drawing pathways 20 communicate with one another directly and in a straight line. By forming such drainage pathways 24, moisture in the hood part 17 is discharged to the back exterior of the hood part 17 through the drainage pathways 24 and the mold drawing pathways 20. Since the drainage pathways 24 and the mold drawing space are connected to each other in a straight line, the drainage effect is high.

<Other Embodiments>

The invention is not limited to the embodiment described above with reference to the drawings, and for example, the following embodiments are also included in the technical scope of the invention.

Although the number of the mold drawing pathways 20 is five in the above-described embodiment, the number of the mold drawing pathways may be four or less and six or more.

Although the mold drawing pathways 20 are formed only on the outer surface (upper surface) of the guide wall part 19 (the wall part formed with the guide recessed part 15 of the outer wall part 16) in the above-described embodiment, it is also possible to form the mold drawing pathways on the outer surfaces (a bottom surface and a side surface) of the lower wall part and the side wall part that are not formed with the guide recessed part of the outer wall part of the terminal holding part, in addition to the outer surface of the guide wall part 19.

Although the mold drawing pathway 20 and the drainage pathway 24 have the same width dimension as in the above-described embodiment, the mold drawing pathway and the drainage pathway may have different width dimensions.

Although the mold drawing ports 22 penetrating through the back surface wall 18 of the mold drawing pathway 20 and the mold drawing recessed parts 21 of the outer surface of the guide wall part 19 are provided in the same number to communicate with one another one-to-one as in the above-described embodiment, a form in which one mold drawing port communicates with a plurality of mold drawing recessed parts may be provided. In this case, the number of the mold drawing port may be one and may be plural number.

The invention claimed is:

1. A connector comprising:

a housing made of a synthetic resin;

a terminal fitting;

a terminal holding part which constitutes the housing and is formed with a terminal accommodating chamber penetrating in a front and back direction;

a hood part which constitutes the housing, is molded integrally with the terminal holding part, and extends forward from a front end of the terminal holding part;

an outer wall part which constitutes an outer surface of the terminal holding part and faces the terminal accommodating chamber;

a back surface wall which constitutes the hood part and has a form of projecting outward from the outer wall part;

a terminal insertion port which constitutes an opening part of a back end part of the terminal accommodating chamber and into which the terminal fitting is inserted;

a posture stabilization part which constitutes a front end side region of the terminal accommodating chamber and holds the inserted terminal fittings so as not to tilt;

a guide recessed part which is formed in a region corresponding to the terminal insertion port of the inner surface of the outer wall part and has a form recessed from the inner surface of the posture stabilization part; and a guide wall part that constitutes a region in which the guide recessed part is formed in a circumferential direction of the outer wall;

wherein a plurality of mold drawing recessed parts is recessed in a region in front of the region corresponding to the guide recessed part of the outer surface of the guide wall part, one mold drawing port or a plurality of mold drawing ports is formed to penetrate through the back surface wall, and the mold drawing ports communicate with each of the mold drawing recessed parts to form a mold drawing pathway extending in the front and back direction together with the mold drawing recessed parts, and a plurality of drainage pathways is recessed in a groove shape and along the front and back direction on an inner peripheral surface of a peripheral wall part constituting the hood part, each of the drainage pathways is formed so as to be connected to the mold drawing pathway in a straight line.

2. The connector according to claim 1, wherein each of the mold drawing pathways and the drainage pathways is formed at the same width.

* * * * *